US005835115A

United States Patent [19]

Kitazawa

[11] Patent Number: 5,835,115

[45] Date of Patent: Nov. 10, 1998

[54] IMAGE RECORDING METHOD AND APPARATUS

[75] Inventor: Hiroaki Kitazawa, Sagamihara, Japan

[73] Assignee: Canon Kabushiki Kaisha, Tokyo, Japan

[21] Appl. No.: 520,144

[22] Filed: Aug. 28, 1995

[30] Foreign Application Priority Data

Aug. 31, 1994 [JP] Japan ..... 6-207203

[51] Int. Cl.[6] ..... B41J 2/05

[52] U.S. Cl. ..... 347/57; 347/9; 347/10

[58] Field of Search ..... 347/57, 9, 10, 347/211, 68; 323/205, 208, 282, 222

[56] References Cited

U.S. PATENT DOCUMENTS 4,727,463 2/1988 Suzuki ..... 363/21

5,172,134 12/1992 Kishida et al. ..... 347/57

*Primary Examiner*—Benjamin R. Fuller
*Assistant Examiner*—Juanita D. Stephens
*Attorney, Agent, or Firm*—Fitzpatrick, Cella, Harper & Scinto

[57] ABSTRACT

It is an object of the present invention to provide an image recording method and apparatus for performing stable image recording with a minimum power consumption. An AND gate performs an AND operation of a clock signal and a printing signal of binary logic in units of pixels, and a transistor is driven. At the driving timing, an induced electromotive force is generated in a choke coil having one end connected to a power supply line. A capacitor is charged with a forward current through a diode. On the other hand, the signal is shift-input to a shift register and latched by a latch circuit in synchronism with a signal. An output from the latch circuit is supplied to a gate circuit in synchronism with a signal to drive a transistor. A current from the capacitor is input to the transistor to heat a heater.

28 Claims, 17 Drawing Sheets

FIG. 16A SCKI
FIG. 16B SI' 10V 5V 0V
FIG. 16C CH1
FIG. 16D CH2
FIG. 16E CVH
DESIRED VOLTAGE LEVEL
DESIRED VOLTAGE LEVEL
THE NUMBER OF PULSES IS INCREASED/DECREASED IN ACCORDANCE WITH DISCHARGE AMOUNT. ALTERNATIVELY, THE VOLTAGE CVH IS MONITORED BY MICROCOMPUTER THROUGH AN A/D CONVERTER.
FIG. 16F LATI*
FIG. 16G GATE*

IMAGE RECORDING METHOD AND APPARATUS

BACKGROUND OF THE INVENTION

The present invention relates to an image recording method and apparatus and, more particularly, to an image recording method and apparatus which have a recording head with a plurality of nozzles.

FIG. 1 is a perspective view of a conventional ink-jet recording apparatus. Referring to FIG. 1, a carriage 1 is translated on a guide shaft 5 by a lead screw 4 interlocked with a carriage motor (not shown). A recording head 2 is fixed on the carriage 1. A color cartridge 10 and a black cartridge 11, both of which are detachable, are mounted along a cartridge guide 3 to supply inks.

Inks discharged from the recording head 2 are sprayed onto a recording medium, i.e., a recording paper sheet 6, which opposes the recording head 2, thereby forming an image. The recording paper sheet 6 is delivered by a feed roller 7, a delivery roller 8, and a sheet press plate 9, all of which are interlocked with a delivery motor (not shown), in a manner interlocked with the printing operation.

FIG. 2 is a perspective view showing the carriage 1 in detail. The color cartridge 10 and the black cartridge 11 are attached from the rear portion of the recording head 2. The inks are supplied from pipes 204 to 207 shown in FIGS. 3A and 3B. The color cartridge 10 has cyan, magenta, and yellow inks in a vessel. The inks are separated from each other by partitions.

FIGS. 3A and 3B are perspective views showing the recording head 2 in detail. A silicon substrate 201 forms a heater or the like associated with the ink-jet discharge principle. A printed board 202 includes a driving circuit of the recording head 2. An aluminum plate 203 has the silicon substrate 201 and the printed board 202. The pipes 204 to 207 supply inks from the color cartridge 10 and the black cartridge 11 to the discharge portions of the recording head 2 through a distributor 208. Nozzle groups 2Y, 2M, 2C, and 2Bk respectively discharge the yellow, magenta, cyan, and black inks.

The nozzles of the recording head 2 are aligned in a line in units of colors. As for the numbers of nozzles for the respective colors, the nozzle group 2Y has 24 nozzles, the nozzle group 2M has 24 nozzles, the nozzle group 2C has 24 nozzles, and the nozzle group 2Bk has 64 nozzles. An interval corresponding to eight nozzles at a pitch equal to that in the nozzle groups 2Y, 2M, 2C, and 2Bk is provided between the nozzle groups 2M and 2C, and between the nozzle groups 2C and 2Bk. Similarly, an interval corresponding to 16 nozzles is provided between the nozzle groups 2C and 2Bk.

The moving direction of the carriage 1 along the lead screw 4 and the guide shaft 5 is called a main scanning direction. The head nozzles are aligned in units of colors in a direction perpendicular to the main scanning direction. This alignment direction is called a subscanning direction.

FIG. 4 is a perspective view showing the internal structure of each of the nozzle groups 2Y, 2M, 2C, and 2Bk. Electrothermal energy transducing elements (heaters) 223 are formed on the substrate 201 of silicon or the like at an equal interval. Resin layers are formed between the heaters 223 to form partitions 228. A liquid channel forming member 227 is bonded on the partitions 228, and a top plate 225 of glass or the like is bonded on the liquid channel forming member 227, thereby forming nozzles 222, liquid channels 226, and a common liquid chamber 224.

FIGS. 5A to 5E are views for explaining the ink discharge principle for a single nozzle of the recording head 2.

FIG. 5A shows a discharge stand-by state. Reference numeral 223*a* denotes an ink; and 223*b*, a liquid channel.

FIG. 5B shows a state wherein the ink discharge heater 223 is heated in accordance with an electrical signal, and a bubble 223*c* is formed.

FIG. 5C shows a state wherein the electrical signal is continuously supplied to the heater 223 to grow the bubble 223*c*.

FIG. 5D shows a state wherein the droplet of the ink 223*a* is discharged.

FIG. 5E shows a state wherein the heater 223 is electrically disconnected, and the ink 223*a* is refilled to the discharge port of the nozzle.

In the above process, it is preferable that the temperature of the heater 223 steeply rises, and accordingly, the temperature of the ink 223*a* near the heater 223 simultaneously increases, thereby performing satisfactory bubble formation. However, it is difficult to always realize an ideal discharge state by only applying a single-phase electrical pulse because of the ambient temperature or the characteristics of the ink. Therefore, a method in which the ambiance of the nozzle 223*b* is warmed in advance prior to heating the heater, and a method in which a preheat pulse is applied immediately before an electrical pulse for bubble formation is applied are used.

In the ink-jet recording apparatus, if the discharge operation is not performed for a long time, the ink in the discharge port or in the liquid channel communicating with the discharge port may be thickened due to water evaporation. When such a thick ink is filled, the internal state of the liquid channel becomes unsuitable for the discharge operation. Even when the heater arranged in the liquid channel is driven under predetermined conditions, the ink discharge amount may vary to result in a degradation in quality of a recorded image. Additionally, a discharge failure may be caused due to such thickening of the ink, or hardening may be caused to impede the discharge operation.

In the ink-jet recording apparatus, if an ink or water droplet, dust, or the like sticks to the surface of the recording head with the ink discharge ports, the discharged ink is drawn by the sticking substance. In this case, the discharge direction may be deflected to degrade the image quality.

To avoid these disadvantages caused in use of a liquid, i.e., an ink as a recording agent, the ink-jet recording apparatus has a unique arrangement unlike any other recording apparatuses, in which a means for refreshing the liquid channel or properly setting the discharge port formation surface, i.e., a discharge recovery system is provided to the recording head.

As a discharge recovery system, various arrangements are available. For example, to refresh the liquid channel, a heater is driven in recording to discharge the ink to a predetermined ink reception medium. Alternatively, a predetermined pressure is caused to act on the liquid channel such that the ink supply system is pressurized, or suction from the ink discharge port is performed, thereby forcibly discharging the ink from the discharge port.

To prevent deflection of the discharge direction by refreshing the discharge port formation surface, a wiping member contacting the discharge port formation surface is arranged, and these two members are relatively moved, thereby removing an ink droplet or dust sticking near the discharge port.

The above recovery systems are designed to operate when an off time determined by the characteristics of an ink or an ink-jet head has elapsed.

FIG. 6 is a block diagram of the electric circuit of the ink-jet recording apparatus. A CPU 501 controls the entire ink-jet recording apparatus and includes a circuit for performing processing such as data transfer. A timer 502 generates a timing necessary for control by the CPU 501 and a synchronization or driving clock for the entire circuit. The timer 502 also includes a timer for measuring a time necessary for the above-described recovery processing.

Printing data sent from a host computer 514 is input to an external interface unit 513 and sent onto a bus line 520. The data is temporarily stored in the buffering area of a RAM 503 under the control of the CPU 501. In accordance with a program stored in a ROM 504, the CPU 501 expands the data to image data in a cooperation with an image processor 505. If the data is a character code, image data corresponding to the character code, which is stored in the ROM 504 in advance, is read out and stored in the image buffer area of the RAM 503. Alternatively, image data corresponding to the character code is formed by a logic circuit. If the image data is color data, the cyan data, magenta data, yellow data, and black data of the image data are respectively stored in a cyan image buffer area 5031, a magenta image buffer area 5032, a yellow image buffer area 5033, and a black image buffer area 5034 of the RAM 503. These image data are sent to a head driver 506 by a data transfer control circuit included in the CPU 501 and printed by the recording head 2. The head driver 506 includes a power element for driving the recording head 2. In addition, the head driver 506 independently has head driving circuits for yellow, cyan, magenta, and black. Each color image data is transferred to the corresponding circuit. An operating unit 511 is a designation input unit from the operator and serves as a man-machine interface for designating a font, online/offline, line feed, and the like. The CPU 501 displays a response with respect to the designation on a display unit 512. Motor drivers 507 and 509 are controlled by the CPU 501 to respectively drive a carriage motor 508 and a delivery motor 510.

FIG. 7 is a block diagram showing the head driver 506 in detail. This arrangement will be described below with reference to FIG. 7.

The heaters 223 are aligned as described above, as shown in FIG. 4. A driving circuit 6061 drives the black printing head nozzle group. A driving circuit 6062 drives the cyan printing head nozzle group. Although not illustrated, a driving circuit 6063 drives the magenta printing head nozzle group. A driving circuit 6064 drives the yellow printing head nozzle group. Power transistors 6021 to 6024 drive the heaters 223. Gate circuits 6031 to 6034 generate a preheat pulse for the above-described recovery system and a main heat pulse for the printing operation in synchronism with reception of a signal GATE* (negative logic). The preheat pulse and the main heat pulse are output from the CPU 501 shown in FIG. 10. An image data signal SI is transferred from the RAM 503 and stored in a shift register 6051 in synchronism with a signal SCKI output from the CPU 501. As for the storing timing, the signal SI at the leading edge of the signal SCKI is stored. An output from the shift register 6051 is supplied to a shift register 6052. An output from the shift register 6052 is supplied to the next shift register (not shown) and finally supplied to a shift register 6054. More specifically, the signal SI sequentially shifts data among the shift registers in synchronism with the signal SCKI. Each color image data is transferred to the corresponding shift register as serial data in an order of yellow, magenta, cyan, and black. The image data is transferred from the shift register to the corresponding one of latch circuits 6041 to 6044. The image data is latched by the corresponding one of the latch circuits 6041 to 6044 in synchronism with a signal LATI* (negative logic) output from the CPU 501.

A power supply line VH supplies a power to the heaters. A smoothing capacitor 607 stabilizes the voltage level of the power supply line VH. A line P. GND is a ground line for the heater driver.

FIG. 8 is a block diagram showing one of the circuits in FIG. 7, which is associated with a single nozzle.

FIG. 9 is a view showing a scanning process of the recording head 2 in color image formation. The recording head 2 according to an embodiment of the present invention has the yellow, magenta, and cyan nozzle groups 2Y, 2M, and 2C each consisting of 24 nozzles, and the black nozzle group 2Bk consisting of 64 nozzles. Character data sent from the host computer 514 is expanded to image data in processing by the image processor 505 and the CPU 501, and stored in the buffer areas 5031 to 5034 of the RAM 503 for storing the image data. Of the image data, data along the nozzle alignment direction, i.e., the subscanning direction is extracted in processing by the CPU 501 in accordance with the scanning operation of the carriage 1 and sent to the head driver 506. Twenty-four dots are printed along the subscanning direction. At this time, the first to 24th nozzles of the black nozzle group 2Bk are used.

In the color printing operation, one main scanning operation is performed in units of 24 nozzles because each of the cyan, magenta, and yellow heads has 24 nozzles. FIG. 10A is a view representing image data of one color of the image data buffers 5031 to 5034. FIG. 10B is a view showing a state wherein the printing operation of the image data until the eighth main scanning operation is completed.

The nozzles of each color of the recording head 2 according to an embodiment of the present invention are aligned in a line. The nozzle group 2Y has 24 nozzles, the nozzle group 2M has 24 nozzles, the nozzle group 2C has 24 nozzles, and the nozzle group 2Bk has 64 nozzles. An interval corresponding to eight nozzles at a pitch equal to that in the nozzle groups 2Y, 2M, 2C, and 2Bk is provided between the nozzle groups 2Y and 2M, and between the nozzle groups 2M and 2C. An interval corresponding to 16 nozzles is provided between the nozzle groups 2C and 2Bk. To perform the printing operation in units of 24 nozzles by using the recording head 2, a scanning process shown in FIG. 9 is required.

Referring to FIG. 9, in the first main scanning operation, the first to 24th nozzles of the black nozzle group 2Bk perform the printing operation for the first line.

In the second main scanning operation, the 17th to 24th nozzles of the cyan nozzle group 2C perform the printing operation for the first line. Simultaneously, the first to 24th nozzles of the black nozzle group 2Bk perform the printing operation for the second line.

In the third main scanning operation, the first to 16th nozzles of the cyan nozzle group 2C perform the printing operation for the first line. Simultaneously, the 17th to 24th nozzles perform the printing operation for the second line. The first to 24th nozzles of the black nozzle group 2Bk perform the printing operation for the third line.

In the fourth main scanning operation, the 24 nozzles of the magenta nozzle group 2M perform the printing operation for the first line. Simultaneously, the first to 16th nozzles of the cyan nozzle group 2C perform the printing operation for the second line. The 17th to 24th nozzles of the cyan nozzle group 2C perform the printing operation for the third line. At this time, the first to 24th nozzles of the black nozzle group 2Bk perform the printing operation for the fourth line.

In the fifth main scanning operation, the 9th to 24th nozzles of the yellow nozzle group 2Y perform the printing operation for the first line. At this time, the 24 nozzles of the magenta nozzle group 2M perform the printing operation for the second line. The first to 16th nozzles of the cyan nozzle group 2C perform the printing operation for the third line. The 17th to 24th nozzles of the cyan nozzle group 2C perform the printing operation for the fourth line. Simultaneously, the first to 24th nozzles of the black nozzle group 2Bk perform the printing operation for the fifth line.

In the sixth main scanning operation, the first to 8th nozzles of the yellow nozzle group 2Y perform the printing operation for the first line. At this time, the 9th to 24th nozzles of the yellow nozzle group 2Y perform the printing operation for the second line. The 24 nozzles of the magenta nozzle group 2M perform the printing operation for the third line. The first to 16th nozzles of the cyan nozzle group 2C perform the printing operation for the fourth line. The 17th to 24th nozzles of the cyan nozzle group 2C perform the printing operation for the fifth line. Simultaneously, the first to 24th nozzles of the black nozzle group 2Bk perform the printing operation for the sixth line.

With the above six scanning processes, color printing in a width corresponding to 24 nozzles can be performed.

FIG. 11 is a view showing the scanning process of the recording head 2 in monochrome printing.

The black nozzle group 2Bk of the recording head 2 has, e.g., 64 nozzles. Character data sent from the host computer 514 is expanded to image data in processing by the image processor 505 and the CPU 501, and stored in the buffer area 5034 of the RAM 503 for storing image data. Of the image data, 48-bit data along the nozzle alignment direction of the black head, i.e., the subscanning direction is extracted in accordance with the scanning operation of the carriage 1 and sent to the head driver 506.

FIG. 12A is a view representing data in the black image data buffer 5034. FIG. 12B is a view showing a state wherein the image data is being printed, i.e., the scanning process. When the printing operation of 48 dots is completed, the recording head 2 moves the recording medium in the subscanning direction by a distance corresponding to 48 dots and performs the printing operation again.

As is apparent from FIG. 11, in one main scanning operation, the first to 48th nozzles of the black nozzle group 2Bk perform the printing operation while providing a pitch corresponding to 48 nozzles.

With the above scanning process, monochrome printing in a width corresponding to 48 nozzles can be performed.

As described above, a large number of heaters are heated to perform the printing operation. To improve the throughput of the sheet, all heaters are ideally simultaneously heated.

However, since the heads on the carriage are electrically connected through a flexible cable or the like, the sectional and surface areas of the power supply line are limited. For this reason, no sufficient power can be supplied to heat the large number of heaters. If the power is insufficient, discharged ink droplets cannot be sufficiently controlled, resulting in a degradation in printing result, i.e., image quality.

A method is also available in which the heaters are divided into some groups and heated. For example, a total of 128 nozzles are heated in units of eight nozzles (eight heaters). In this case, eight nozzles will be called a block.

According to this arrangement, the time until all nozzles are heated increases to 16 times that required for simultaneously heating all nozzles, resulting in a decrease in throughput.

Even in the method of heating the nozzles in units of eight nozzles, degradation in printing quality may be caused if stabilization of the power supply is insufficient.

SUMMARY OF THE INVENTION

The present invention has been made in consideration of the above prior art, and has as its object to provide an image recording method and apparatus for performing stable image recording with a minimum power consumption.

According to the present invention, the foregoing object is attained by providing an image recording method for performing a recording operation by discharging an ink onto a recording medium, comprising: a power generation step of generating a power on the basis of image data, an accumulating step of accumulating the power generated in the power generation step, a heating step of supplying the accumulated power by the accumulating step to a heater to heat said heater according to the image data, and a discharging step of discharging said ink from a recording head onto said recording medium on the basis of a thermal energy from the heater heated in the heating step.

Further, the foregoing object is attained by providing an image recording method for performing a recording operation by discharging an ink onto a recording medium, comprising: a first power generation step of generating a first power on the basis of image data, a second power generation step of generating a second power at a non-recording timing of the image data onto said recording medium, an accumulating step of accumulating the power generated in the first power generation step and the second power generation step, the heating step of supplying the accumulated power by the accumulating step to a heater to heat said heater on the basis of the image data, and the discharge step of discharging said ink from a recording head onto said recording medium on the basis of a thermal energy from said heater heated in the heating step.

Furthermore, the foregoing object is attained by providing an image recording apparatus for performing a recording operation by discharging an ink onto a recording medium, comprising: power generation means for generating a power on the basis of image data, accumulating means for accumulating the power generated by said power generation means in charging means, heating means for supplying the power from said charging means to a heater to heat said heater according to the image data, and discharging means for discharging said ink from a recording head onto said recording medium on the basis of a thermal energy from the heater heated by said heating means.

Furthermore, the foregoing object is attained by providing an image recording apparatus for performing a recording operation by discharging an ink onto a recording medium, comprising: first power generation means for generating a first power on the basis of image data, second power generation means for generating a second power at a non-recording timing of the image data onto said recording medium, accumulating means for accumulating the power generated by said first power generation means and said second power generation means in charging means, heating means for supplying the power from said charging means to a heater to heat said heater according to the image data, and discharge means for discharging said ink from a recording head onto said recording medium on the basis of a thermal energy from said heater heated by said heating means.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will be described in detail in accordance with the accompanying drawings.

One point in an ink-jet recording apparatus according to the embodiments of the present invention is that a means for accumulating electric charges in the power supply of a recording head, and a means for increasing the accumulated electric charges in the power supply for the recording head in accordance with a data amount in image data, which requires ink discharge are provided.

With this arrangement, when the number of nozzles heated in accordance with the image data, which is preferably digital, is large, processing is performed, prior to ink discharge, in which electric charges are excessively accumulated in the electric charge accumulation means connected to the head power supply unit.

[First Embodiment]

Figure 1:
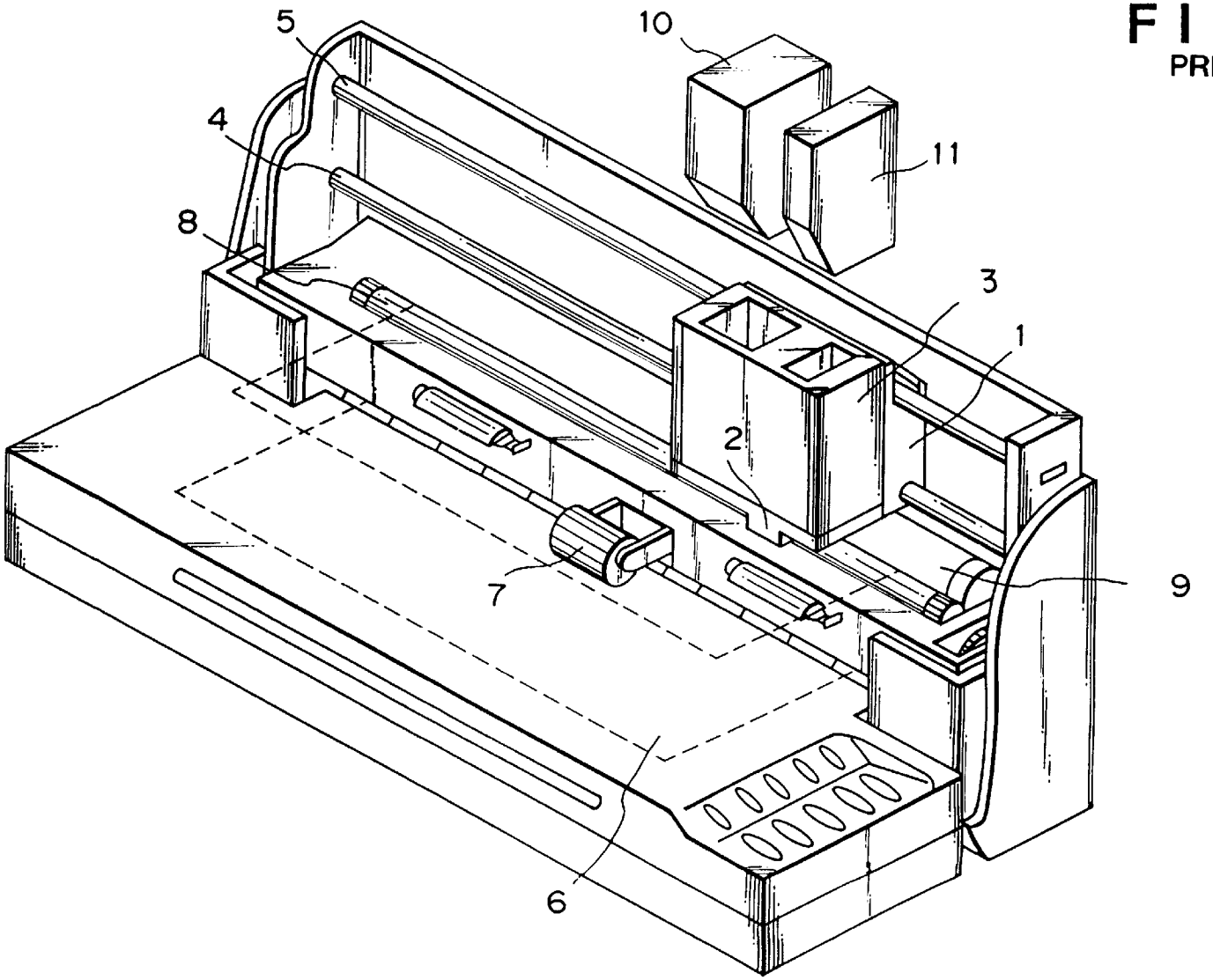
FIG. 1 PRIOR ART
FIG. 1 is a perspective view showing the entire arrangement of a conventional ink-jet recording apparatus.
Figure 2:
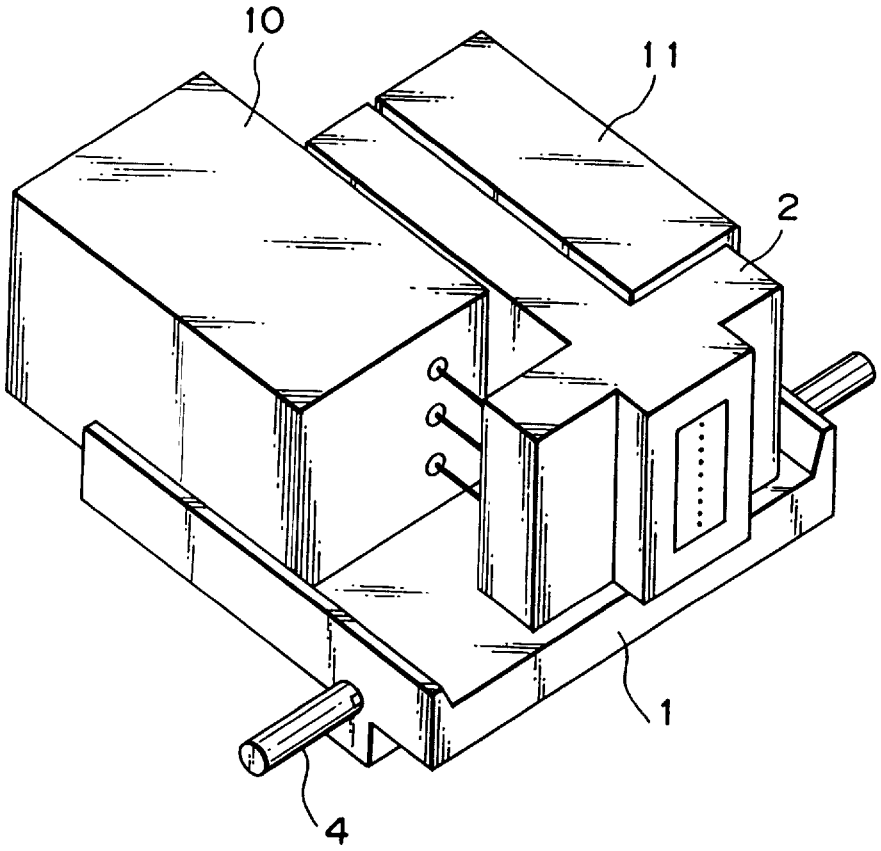
FIG. 2 PRIOR ART
FIG. 2 is a perspective view showing a carriage mounted in the ink-jet recording apparatus in detail.
Figure 3A:
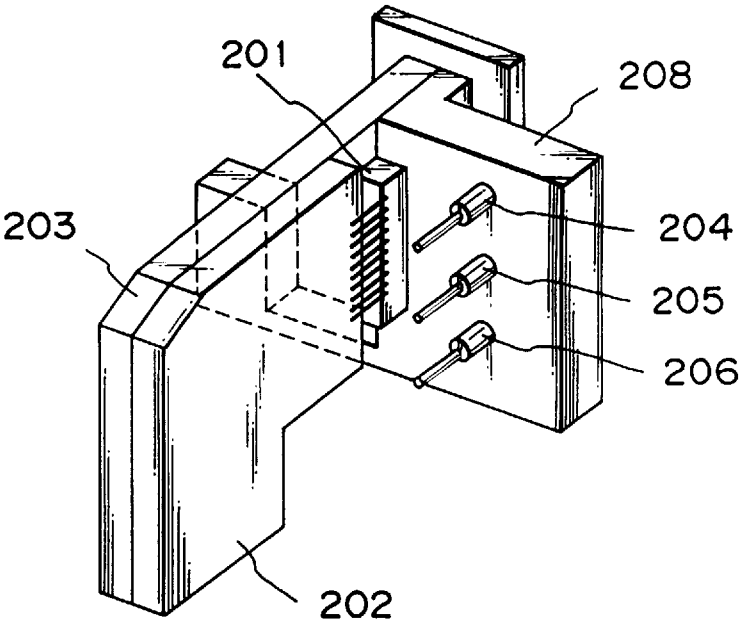
FIG. 3A PRIOR ART
FIG. 3A is a perspective view showing an ink-jet head mounted in the ink-jet recording apparatus in detail.
Figure 3B:
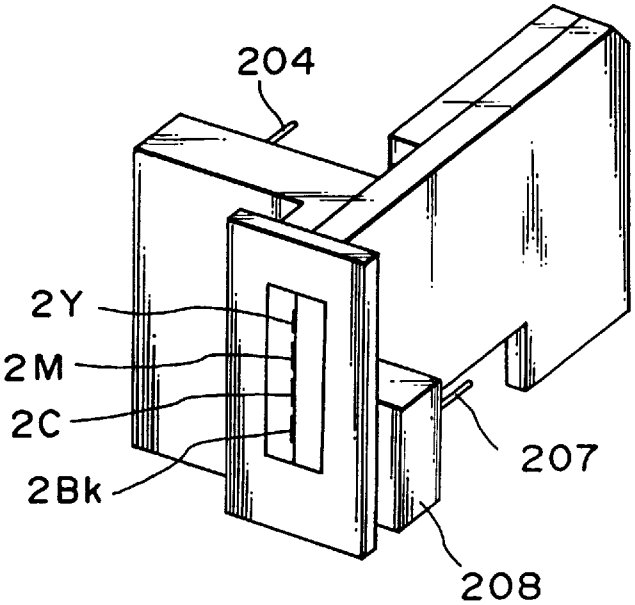
FIG. 3B PRIOR ART
FIG. 3B is a perspective view showing the ink-jet head mounted in the ink-jet recording apparatus in detail.
Figure 4:
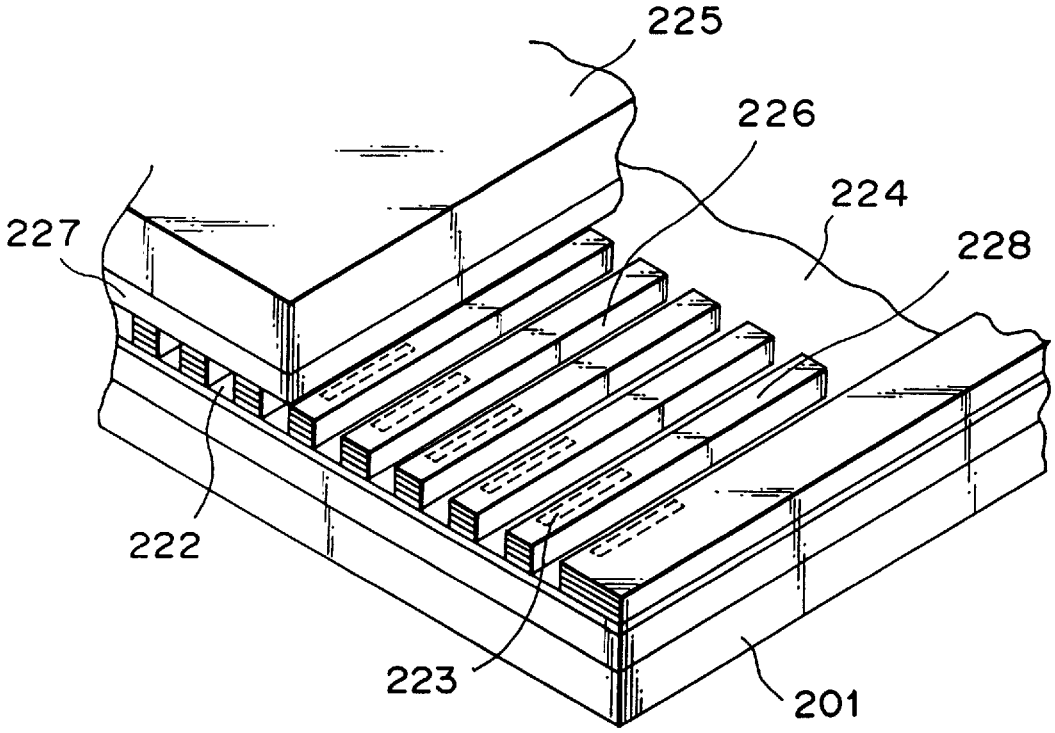
FIG. 4 PRIOR ART
FIG. 4 is a perspective view showing the internal structure of the ink-jet head mounted in the ink-jet recording apparatus in detail.
Figure 5A:
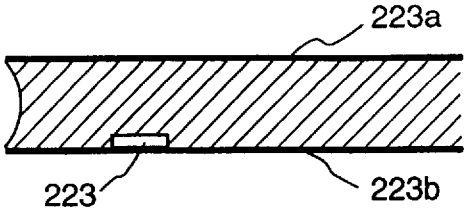
FIG. 5A PRIOR ART
FIGS. 5A to 5E are views for explaining the ink-jet discharge principle.
Figure 5B:
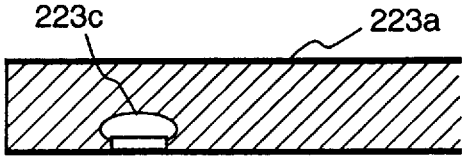
FIG. 5B PRIOR ART
Figure 5C:
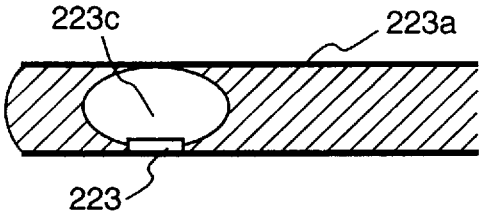
FIG. 5C PRIOR ART
Figure 5D:
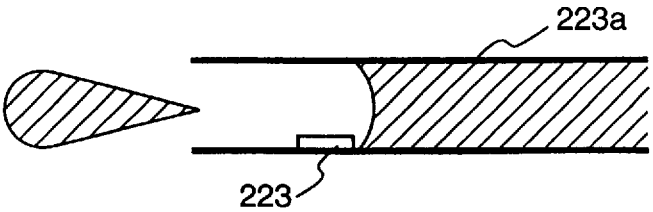
FIG. 5D PRIOR ART
Figure 5E:
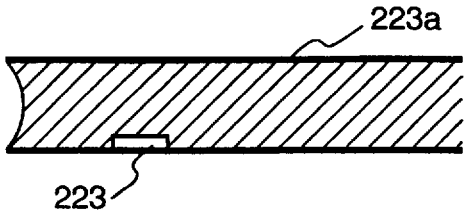
FIG. 5E PRIOR ART
Figure 6:
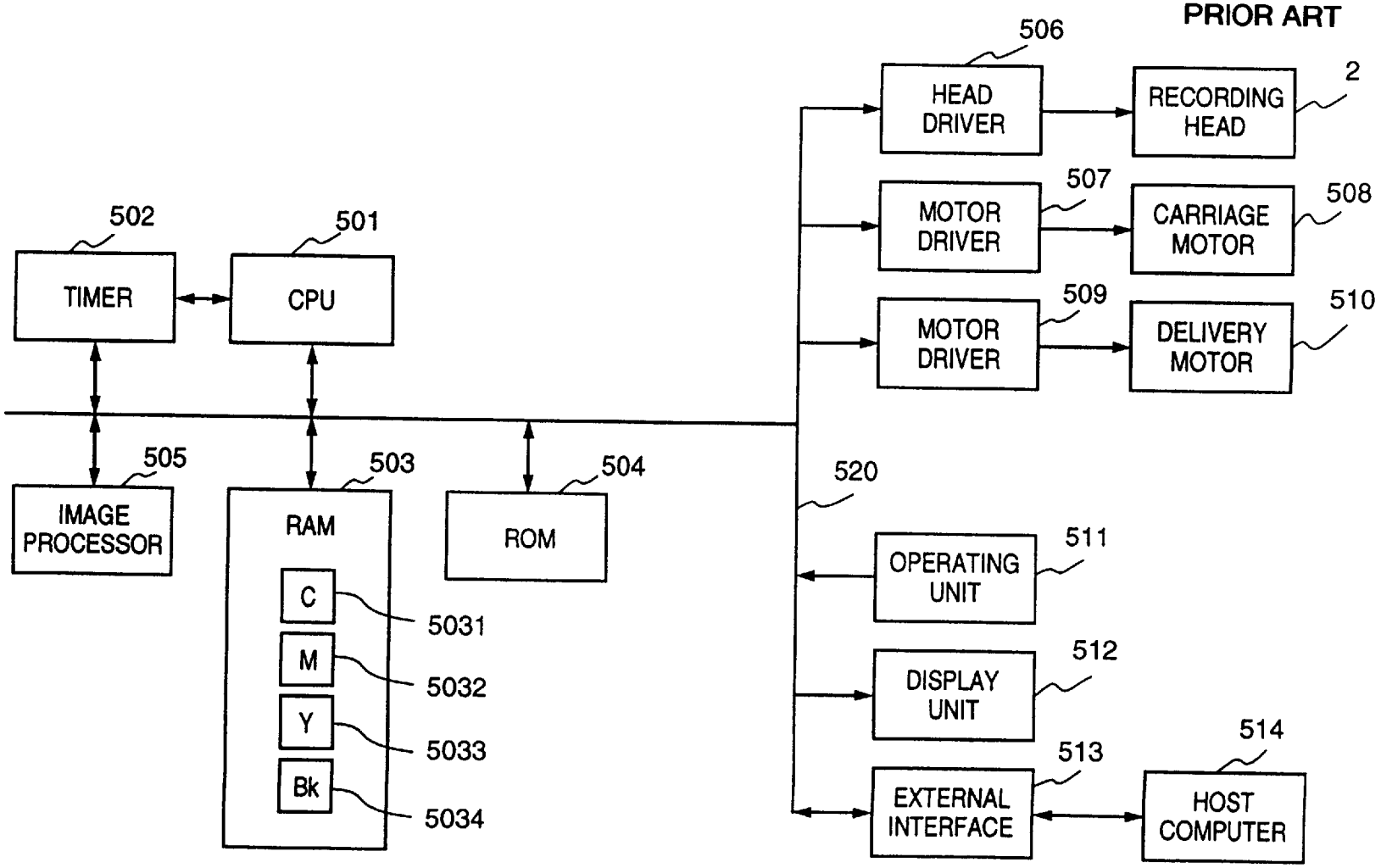
FIG. 6 PRIOR ART
FIG. 6 is a block diagram showing the arrangement of the electric circuit of the conventional ink-jet recording apparatus.
Figure 7:
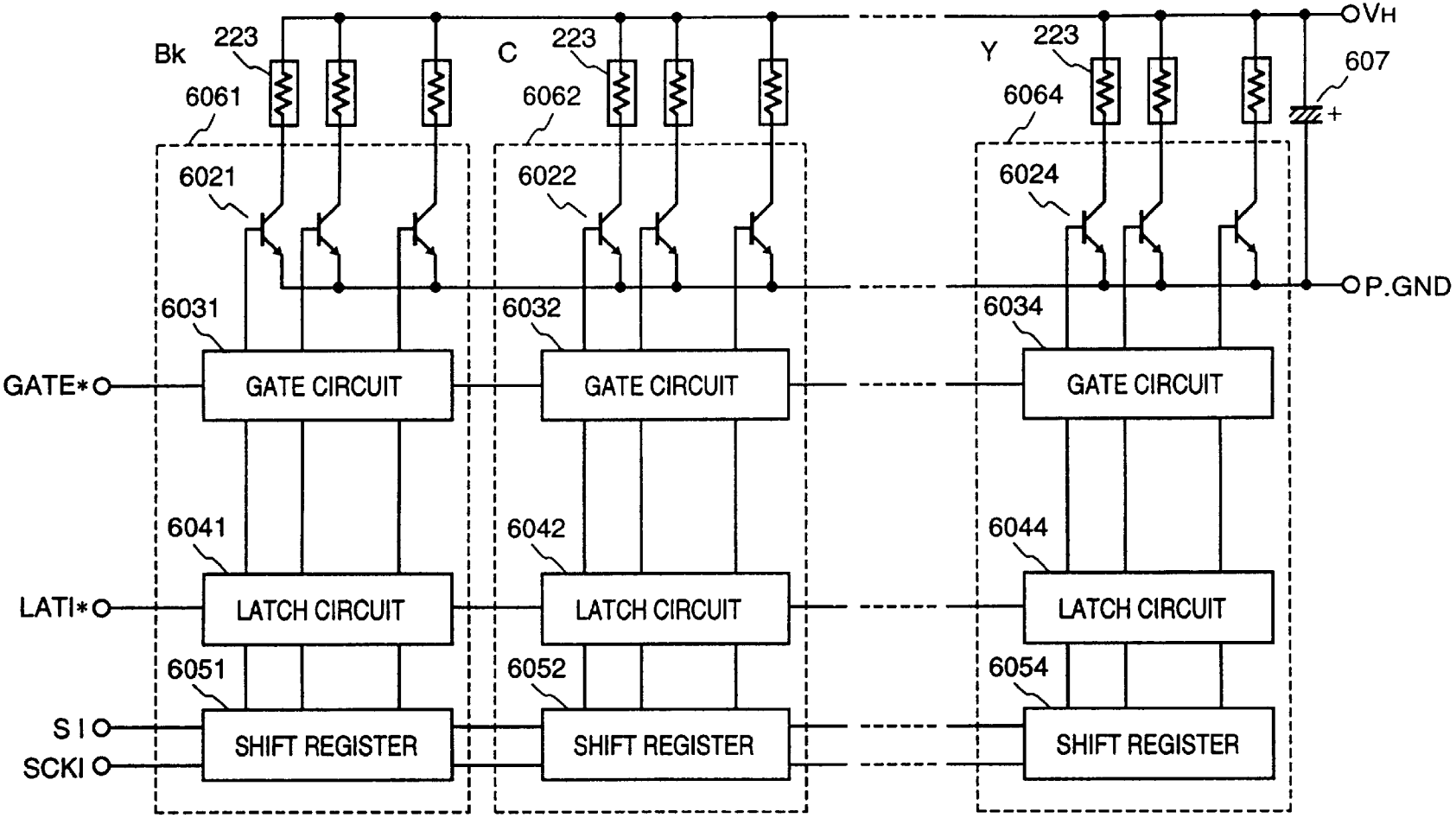
FIG. 7 PRIOR ART
FIG. 7 is a circuit diagram of a head driver portion.
Figure 8:
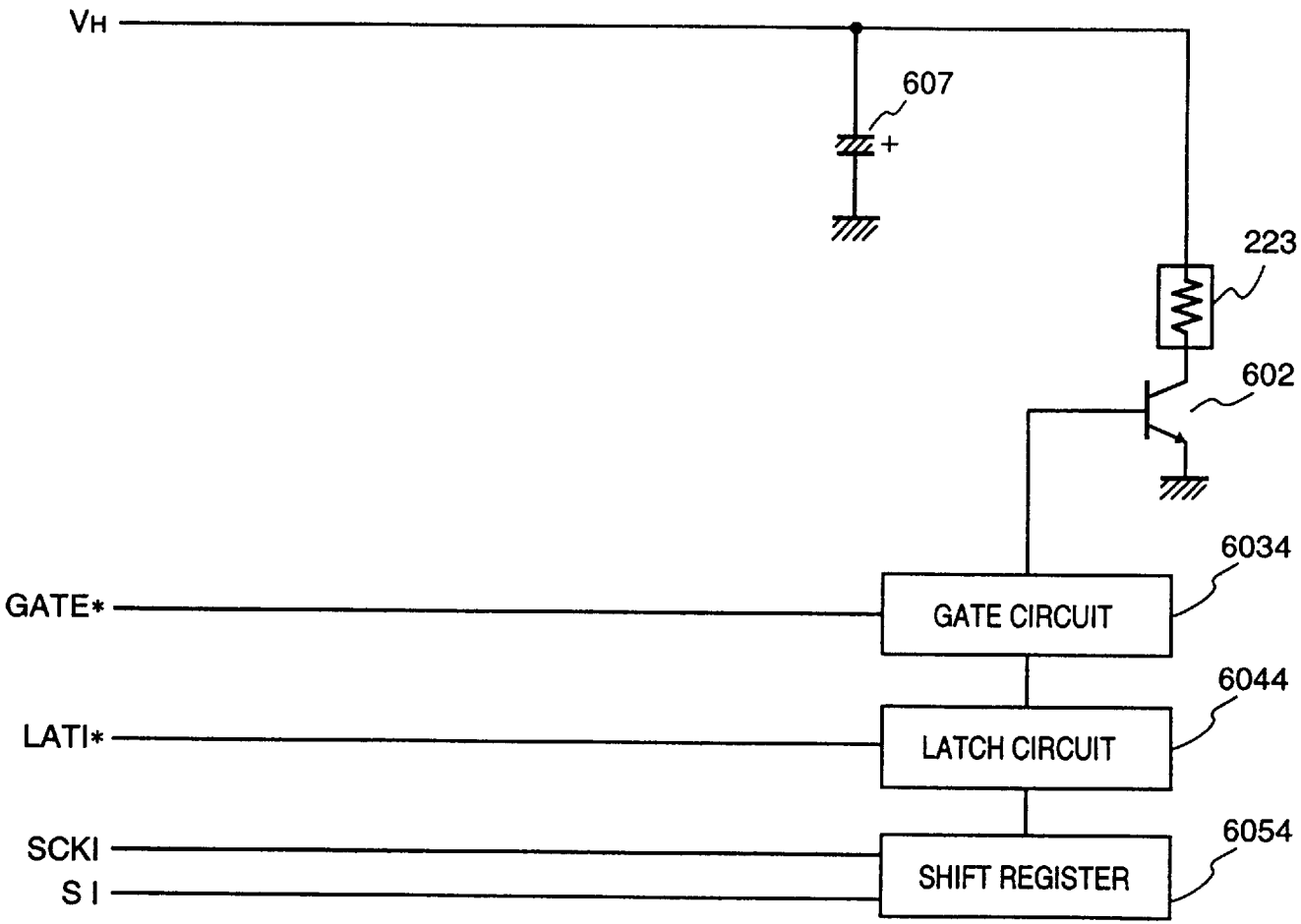
FIG. 8 PRIOR ART
FIG. 8 is a block diagram for explaining a circuit of the head driver portion, which is associated with a single heater.
Figure 9:
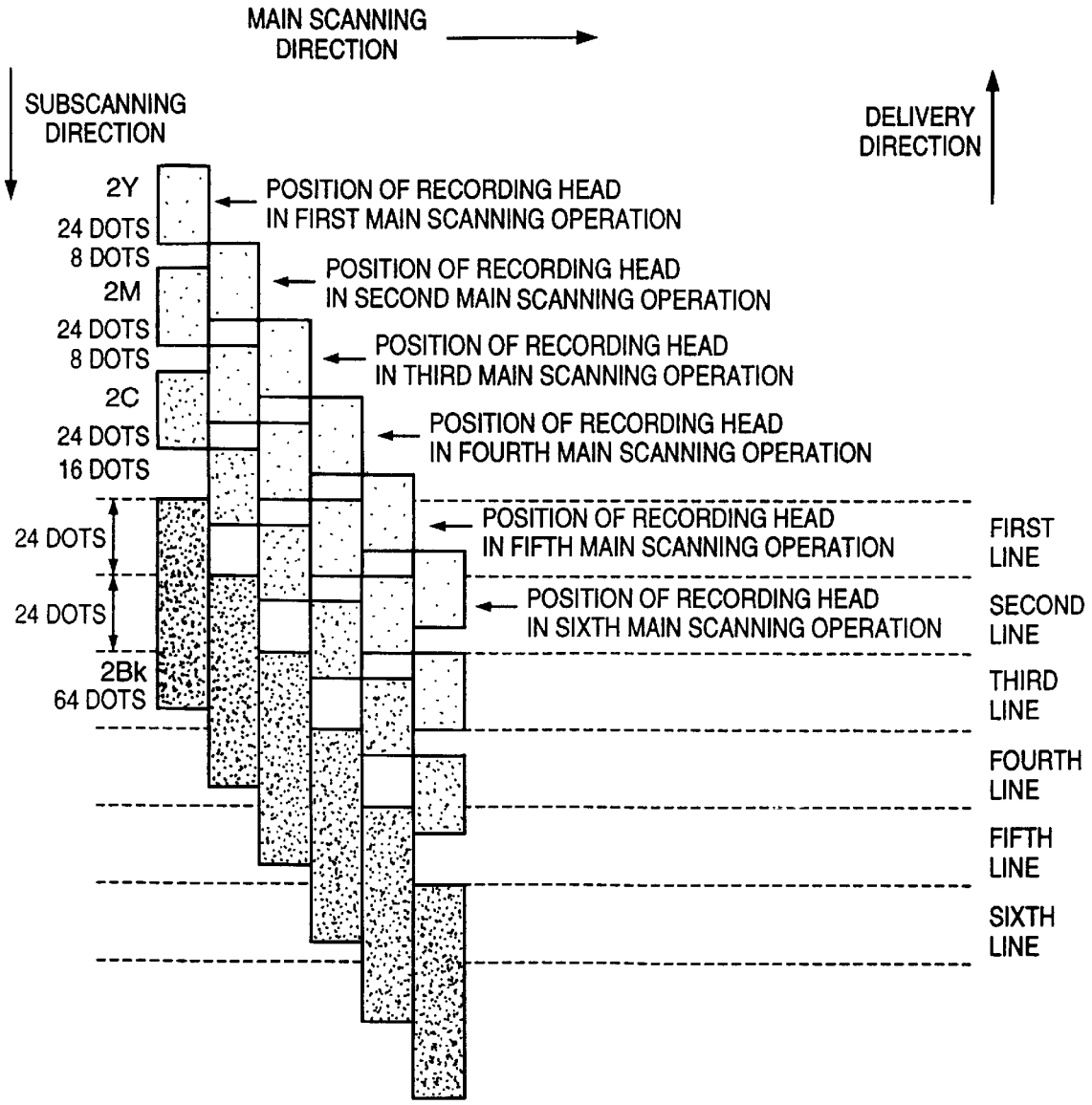
FIG. 9 PRIOR ART
FIG. 9 is a view for explaining a scanning process in color printing.
Figure 10A:
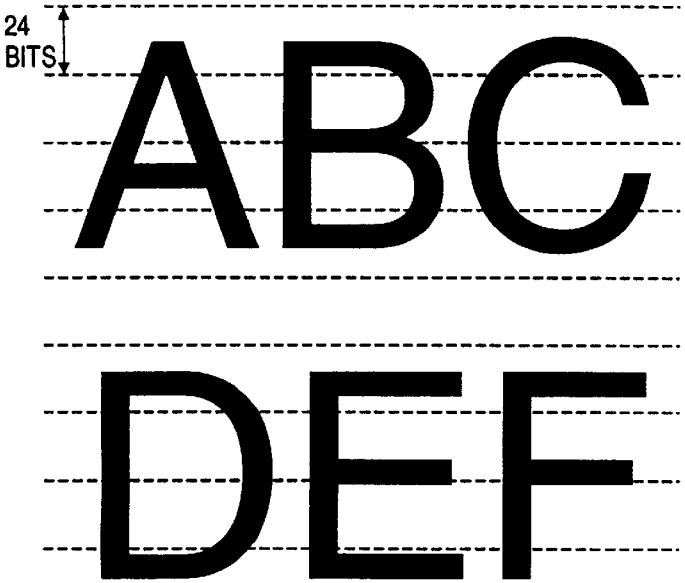
FIG. 10A PRIOR ART
FIGS. 10A and 10B are views for explaining the scanning process in color printing.
Figure 10B:
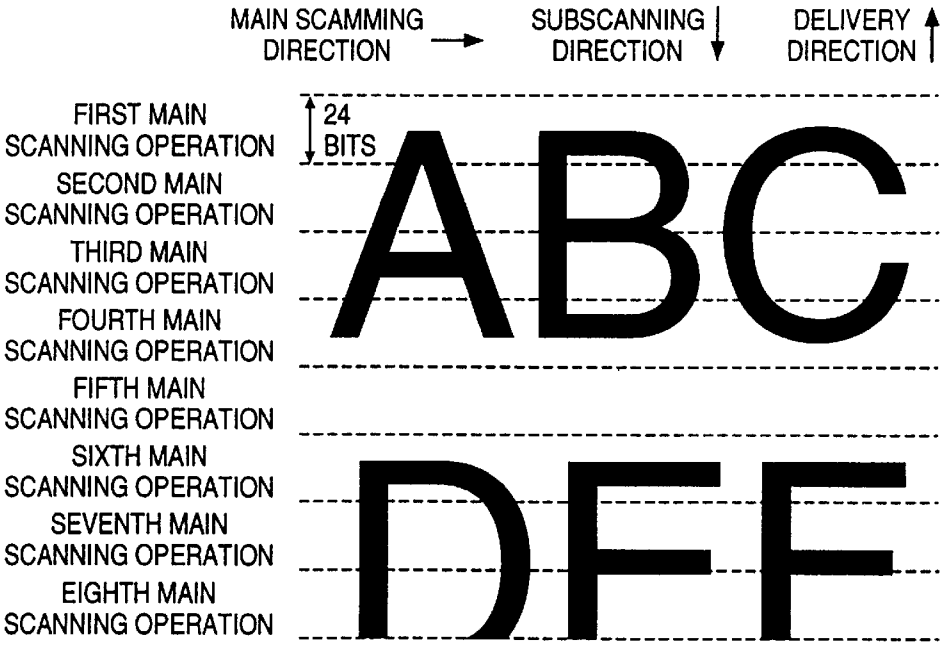
FIG. 10B PRIOR ART
Figure 11:
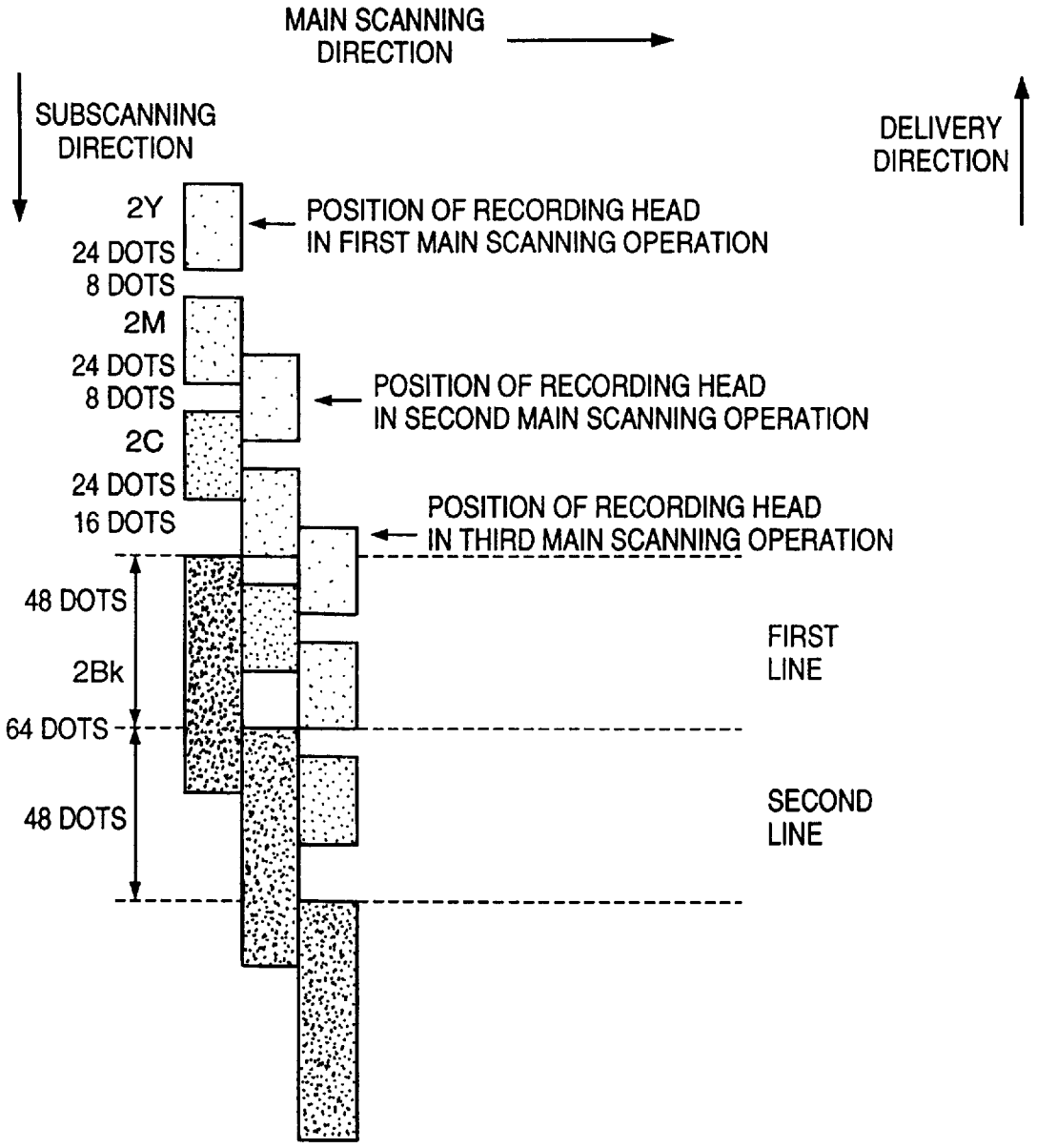
FIG. 11 PRIOR ART
FIG. 11 is a view for explaining a scanning process in monochrome printing.
Figure 12A:
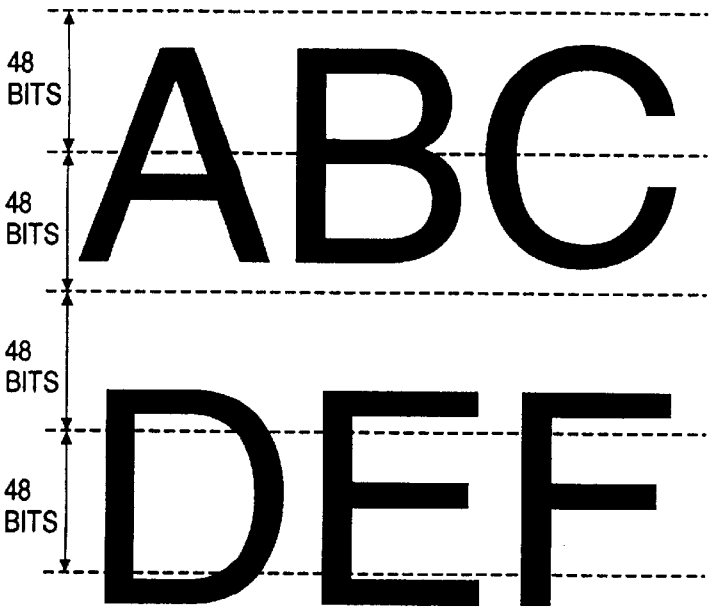
FIG. 12A PRIOR ART
FIGS. 12A and 12B are views for explaining the scanning process in monochrome printing.
Figure 12B:
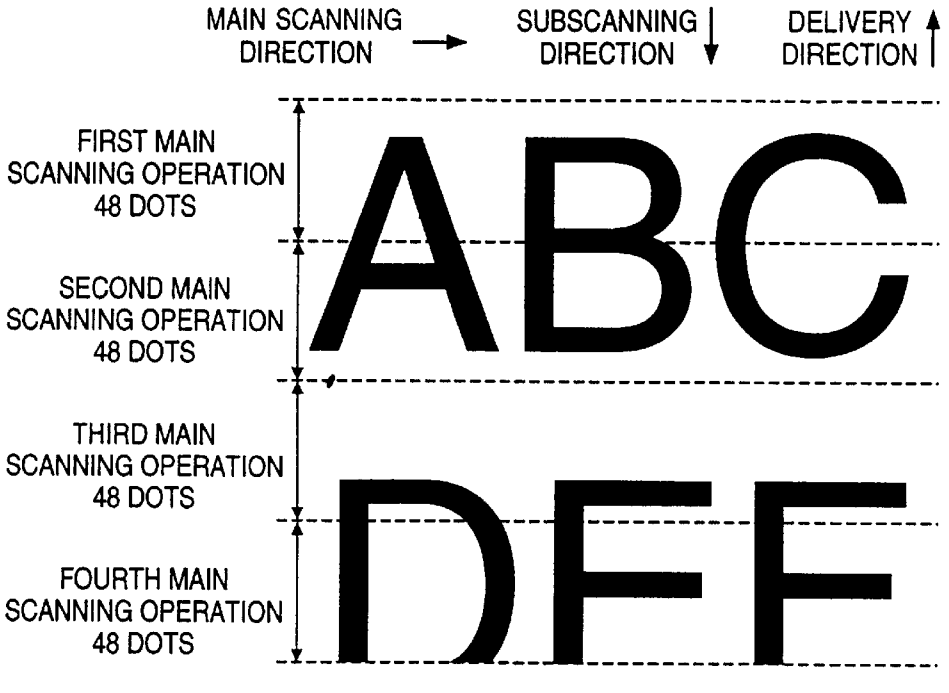
FIG. 12B PRIOR ART
Figure 13:
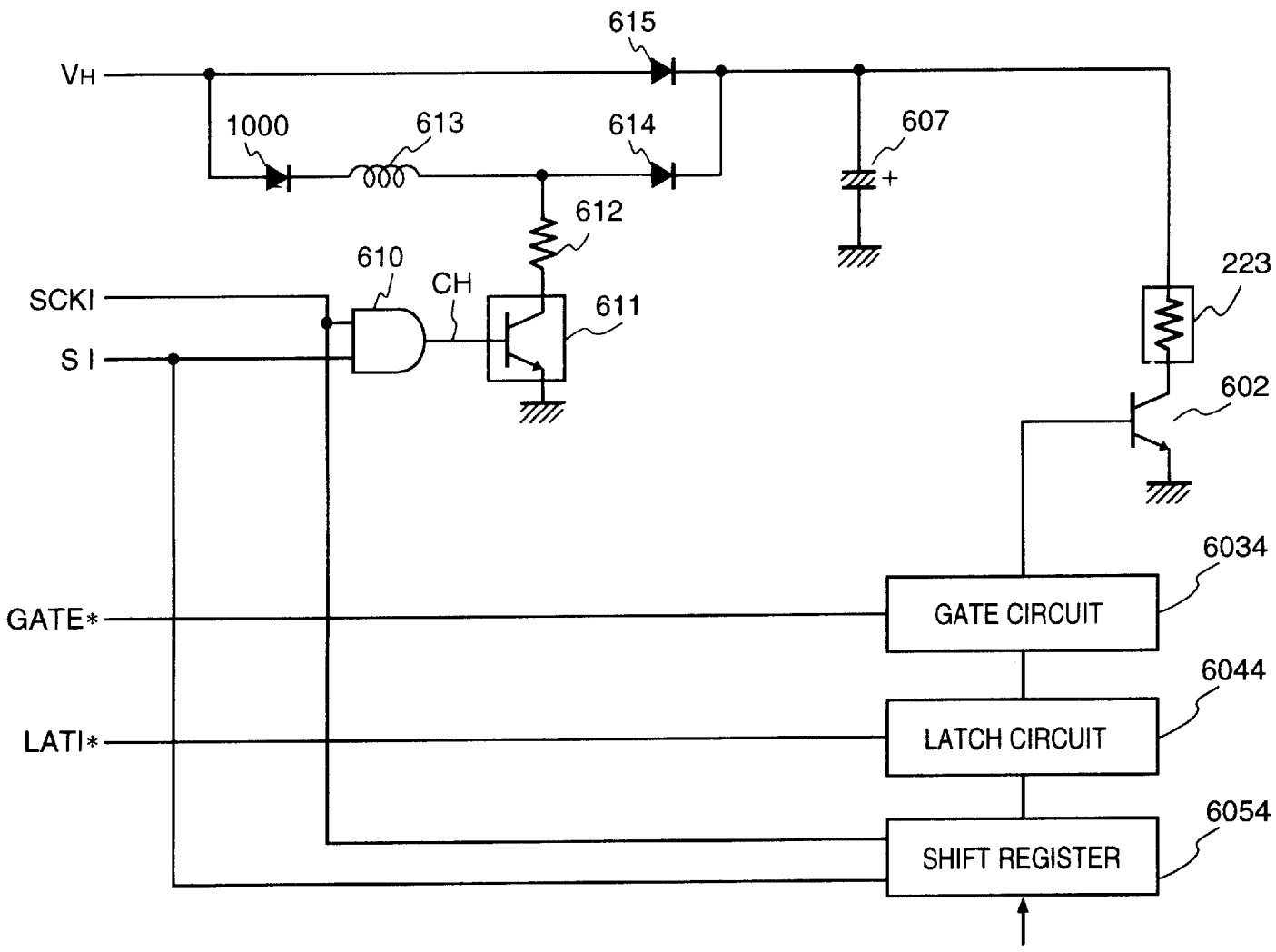
FIG. 13 is a block diagram showing the arrangement of an electric circuit representing the typical characteristic feature of the first embodiment.

FIG. 13 is a block diagram of an electric circuit portion representing the typical characteristic feature of this embodiment. For the descriptive convenience, only portions different from FIG. 8 will be described.

Reference numeral 610 denotes an AND gate; 611, a transistor including a resistor, a counter electromotive force protective diode, and the like (none are shown); 612, a protective resistor for protecting the transistor 611 from being destroyed by a current of a counter electromotive force generated in a choke coil 613; and 614 and 615, diodes for preventing a reverse current.

The operation will be described below with reference to a timing chart comprised of FIGS. 14A–14F.

When a heater 223 is to be heated, logic level "1" is given to printing data. At the leading edge of a clock signal supplied from a terminal SCKI, the level of a signal SI as image data is determined as printing data, i.e., stored in a shift register 6054.

Figures 14A, 14B, 14C, 14D, 14E, 14F:
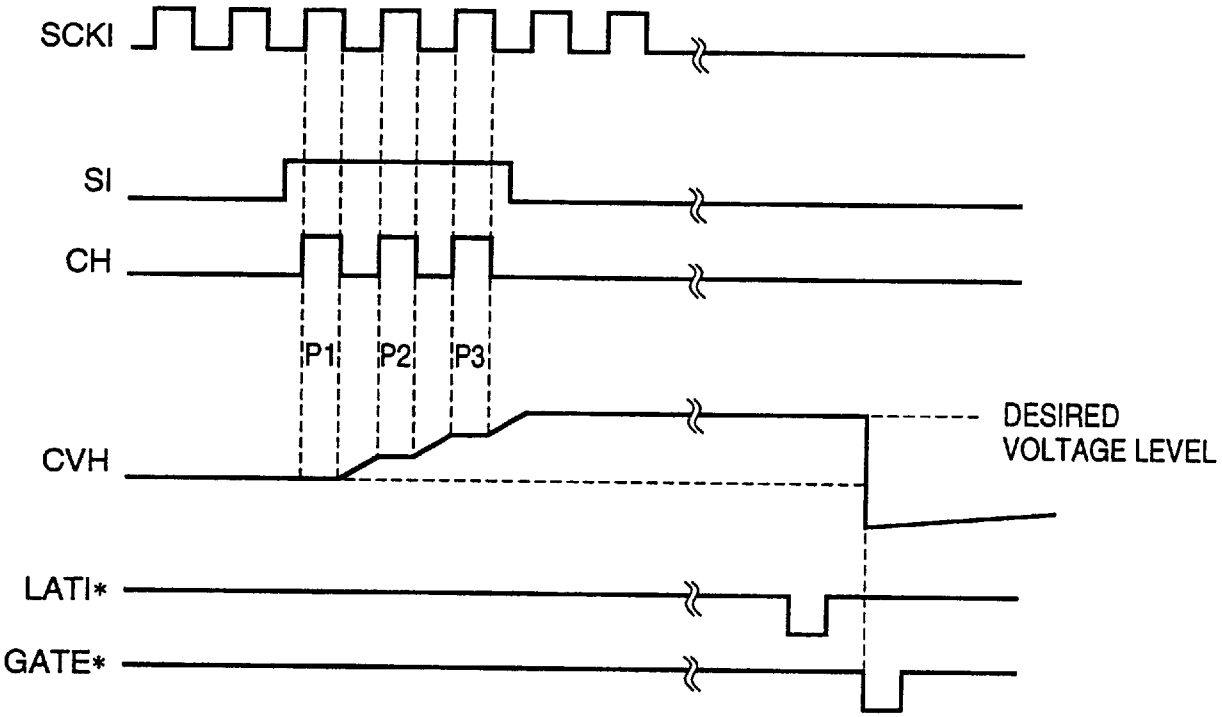
FIGS. 14A–14F comprise a timing chart for explaining the operation of the first embodiment.

Referring to FIG. 13, a signal CH in FIG. 14C is a signal applied to the base of the transistor 611 as a result of the AND operation (AND gate 610) of the signal SCKI and the signal SI. When the signal CH goes to logic level "1", the transistor 611 is turned on, and a current flows through the choke coil 613. When the signal CH goes to logic level "0", the transistor 611 is turned off. At this time, a current generated by a counter electromotive force generated in the choke coil 613 passes through the diode 614, and the electric charges are accumulated in an electrolytic capacitor 607. This current is prevented by the diode 615 from reversely flowing.

Reference numeral 1000 in FIG. 13 denotes a backflow prevention diode for avoiding damage due to a current flow into the power supply for supplying a power VH when an induced electromotive force is generated in the choke coil 613.

An increase in anode voltage of the electrolytic capacitor 607 during pulse intervals P1 to P3 of the signal CH shown in FIG. 14C is represented as a voltage CVH. The printing data stored in the shift register 6054 is stored in a latch circuit 6044 in synchronism with a signal LATI* (* represents the negative logic).

The electric charges accumulated in the electrolytic capacitor 607 are consumed in heating the heater 223 in synchronism with a signal GATE* (negative logic).

When the number of printing data for heating the heater 223, i.e., the number of data at logic level "1" is large, the voltage CVH increases. Therefore, a sufficiently high voltage can be applied as a power supply voltage applied to the heater 223.

As described above, the wait time until the power supply voltage is stabilized from heating one block to heating the next block can be decreased. As a result, the time until all nozzles are heated can be shortened.

[Second Embodiment]

In the first embodiment, when the signal SI for causing ink discharge is at logic level "1", an induced electromotive force is generated to sufficiently charge the capacitor 607. In this embodiment, the charge level of a capacitor 607 is controlled using a non-printing period, e.g., in correspondence with the ink discharge amount from a nozzle, and a power is more stably supplied to a heater 223, thereby performing high-quality image formation.

Figure 15:
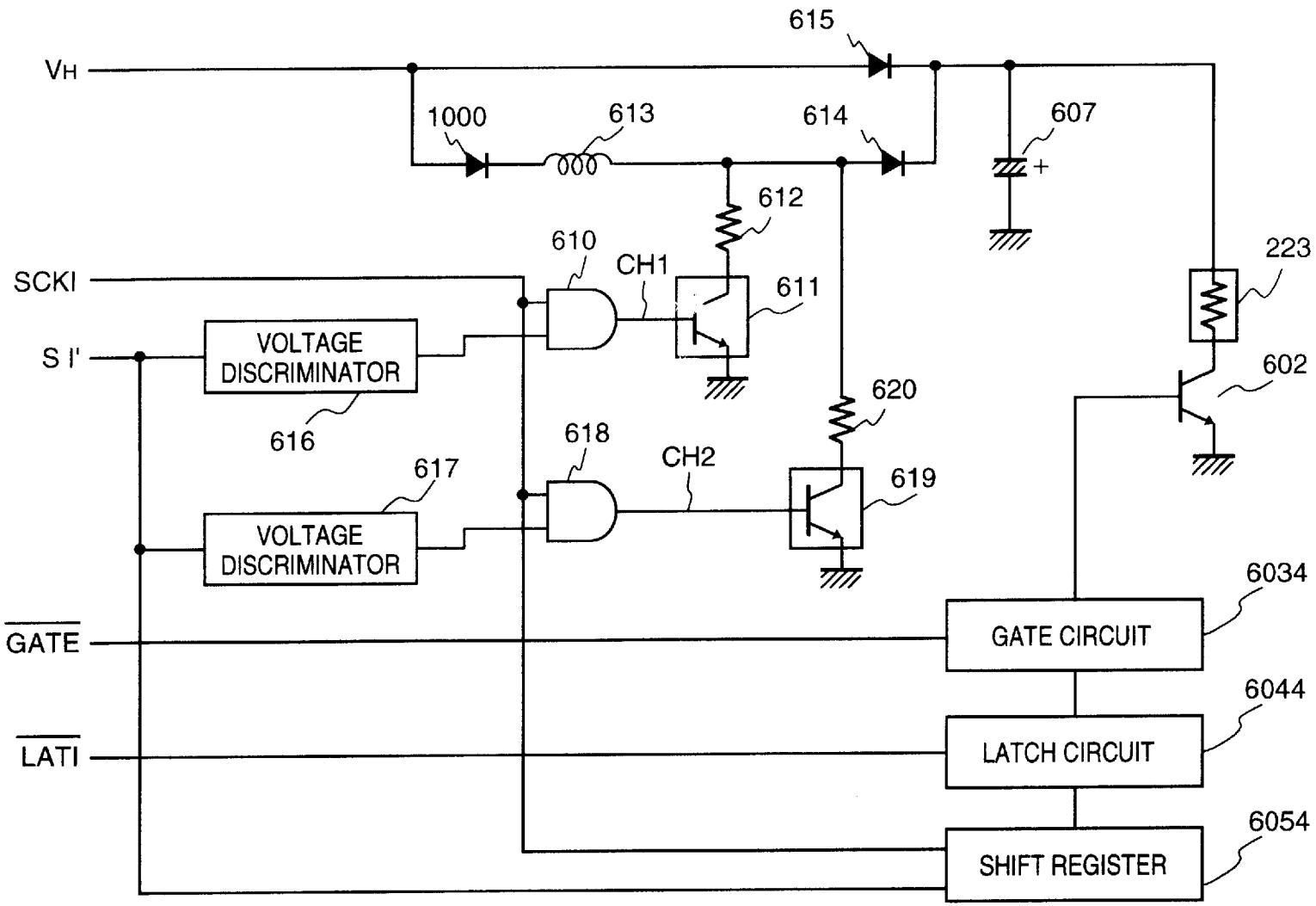
FIG. 15 is a block diagram showing the arrangement of the electric circuit of the second embodiment.
Figure 16:
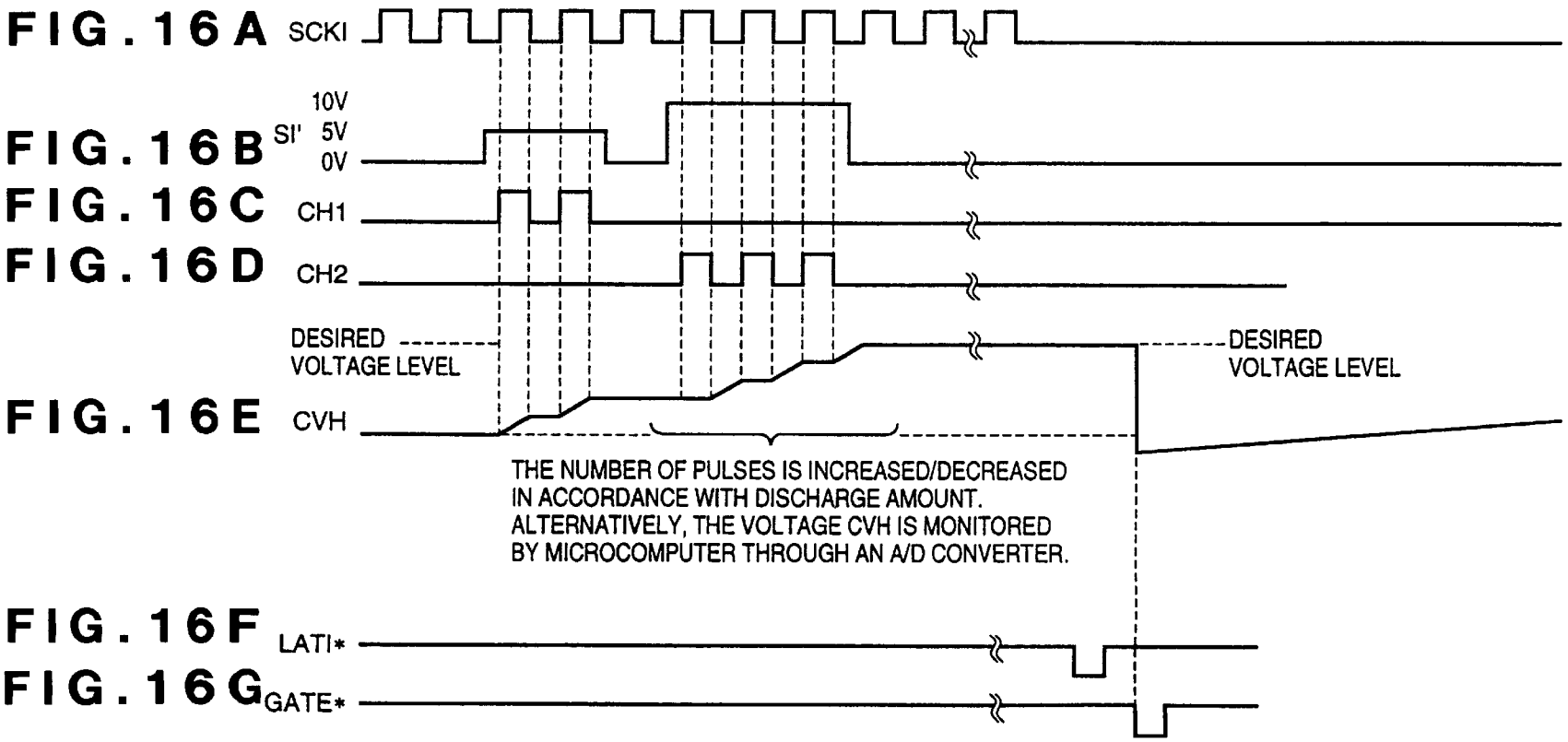
FIGS. 16A–16G comprise a timing chart for explaining the operation of the second embodiment.

FIG. 15 is a block diagram showing the electric circuit portion of the second embodiment. For the descriptive convenience, a detailed description of the same parts as in the first embodiment will be omitted, and a point of the second embodiment will be mainly described.

A signal SI' in FIG. 15 is different from the signal SI having two values (0V and 5V) in the first embodiment. A third voltage level for charging the capacitor 607 during a non-printing interval is added. This voltage level is assumed to be 10 V. More specifically, in the second embodiment, the signal SI' of the second embodiment has a total of three values, i.e., two values (0V and 5V) for printing control and an additional value (10 V) for charging the capacitor 607 during a non-printing interval. The signal SI' is supplied to voltage discriminators 616 and 617. The voltage discriminator 616 determines whether the voltage of the signal SI' is 5 V. If YES, a voltage of 5 V is output to charge the capacitor 607 at the timing of ink discharge. If the input signal has a voltage of 0 V or 10 V, the output is 0 V, so no request for charging the capacitor 607 is output.

The voltage discriminator 617 determines whether the voltage of the signal SI' is 10 V. If YES, a voltage of 5 V is output to charge the capacitor 607. If the input signal has a voltage of 0 V or 5 V, the output is 0 V, so no request for charging the capacitor 607 is output.

FIGS. 16A–16G comprise a timing chart associated with the circuit in FIG. 15. In this case, the signal SI' has a pattern including a 5-V output interval and a 10-V output interval. While the signal SI' outputs a voltage of 5 V, two pulses are generated as a signal CH1 as an output from an AND gate 610. At this generation timing, an induced electromotive force is generated in a choke coil 613 to charge the capacitor 607. As for a signal CVH, i.e., the charge voltage level of the capacitor 607 at this timing, it is found that the voltage increases in correspondence with the charge. On the other hand, while the signal SI' outputs a voltage of 10 V, three pulses are generated as a signal CH2 as an output from an AND gate 618. At this generation timing, an induced electromotive force is generated in the choke coil 613 to charge the capacitor 607. As for the signal CVH, i.e., the charge voltage level of the capacitor 607 at this timing, it is found that the voltage increases in correspondence with the charge, and the capacitor 607 is charged to a desired charge level. After the charge voltage level of the capacitor 607 is sufficiently increased, a signal GATE* as a timing signal for heating the heater 223 is input.

When the ink discharge amount is detected by a sensor (not shown), and a CPU 501 determines whether the discharge amount is appropriate and controls the number of pulses of the signal CH2, i.e., adjusts the 10-V output interval of the signal SI', the charge level of the capacitor 607 can be controlled, as a matter of course.

Reference numeral 1000 in FIG. 15 denotes a backflow prevention diode for avoiding damage due to a current flow into the power supply for supplying a power VH when an induced electromotive force is generated in the coil 613.

As described above, the 10-V output interval of the signal SI' is controlled during a non-printing interval. With this operation, the capacitor 607 can be sufficiently charged in advance to allow stable image formation.

According to this embodiment, electric charges can be accumulated in the capacitor 607 independently of the number of printing data at logic level "1". Therefore, the stability of the heater temperature can be increased, and stable image formation can be performed.

[Third Embodiment]

Figure 17:
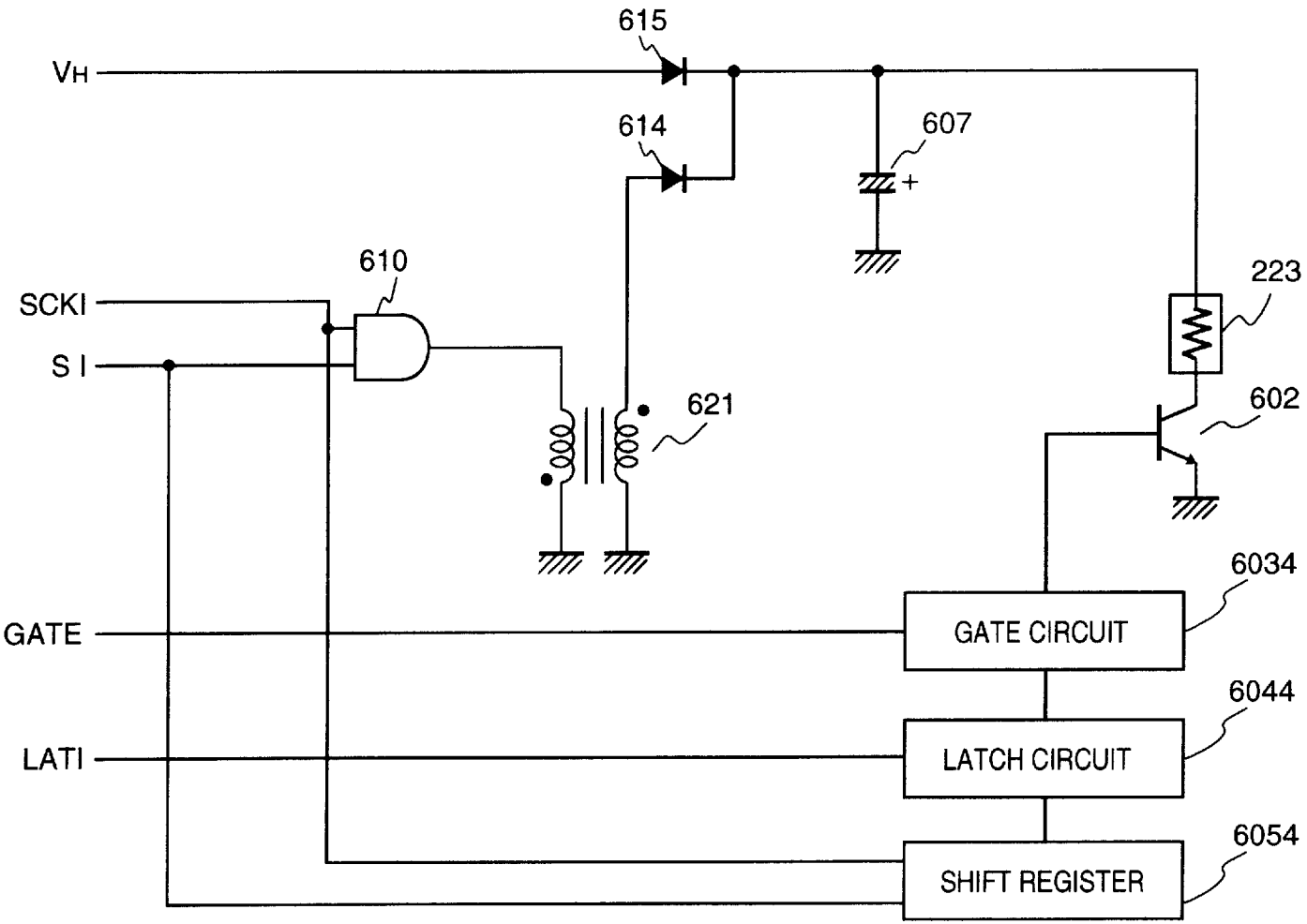
FIG. 17 is a block diagram showing the arrangement of the electric circuit of the third embodiment.

FIG. 17 is a block diagram showing the electric circuit portion of the third embodiment. For the descriptive convenience, only parts different from FIG. 13 will be described.

Reference numeral 621 denotes a transformer. The primary and secondary windings have a negative phase. The turn ratio is appropriately selected in accordance with the characteristics of the circuit.

As an operation, a current is generated in the primary winding of the transformer 621 by outputting a signal as an AND of a signal SI and a signal SCKI, as in the first embodiment. With this operation, a negative-phase current is generated in the secondary winding so that an electrolytic capacitor 607 can be charged.

As the effect of the above arrangement, the wait time until the power supply voltage is stabilized from heating one block to heating the next block can be decreased. As a result, the time until all nozzles are heated can be shortened.

The present invention may be applied to a system constituted by a plurality of devices or an apparatus constituted by one device. The present invention can also be applied to a case wherein the above-described function is achieved by supplying programs to a system or an apparatus, as a matter of course.

According to this embodiment, the wait time until the power supply voltage is stabilized to heat the next block can be decreased. As a result, the time until all nozzles are heated can be shortened. Therefore, the printing result can be improved, and a higher throughput can be ensured.

As has been described above, according to the present invention, stable image recording can be performed with a minimum power consumption.

As many apparently widely different embodiments of the present invention can be made without departing from the spirit and scope thereof, it is to be understood that the invention is not limited to the specific embodiments thereof except as defined in the appended claims.

What is claimed is:

1. An image recording method for performing a recording operation by discharging ink onto a recording medium, comprising the steps of:

a power generation step of generating power based on image data;

an accumulating step of accumulating the power generated in said power generation step in an electrical charging device;

a heating step of supplying the accumulated power in said accumulating step to a heater to heat the heater according to the image data; and a discharging step of discharging the ink from a recording head onto said recording medium based on thermal energy from the heater heated in said heating step.

2. The method according to claim 1, wherein the power generation step comprises generating an AC signal based on the image data to generate an induced electromotive force in a choke coil on the basis of the AC signal.

3. The method according to claim 1, wherein the accumulating step comprises rectifying the power generated in the power generation step to charge the electrical charging device.

4. The method according to claim 3, wherein said accumulating step is effected with a capacitor.

5. The method according to claim 1, wherein the image data utilized in said heating step comprises digital data.

6. The method according to claim 1, wherein in said discharging step said recording head causes a change in state of the ink by the thermal energy applied by said heater to cause the ink to be discharged from a discharge port based on the change in state.

7. The method according to claim 1, wherein the power generation step comprises generating an AC signal based on the image data to generate an induced electromotive force in a transformer.

8. An image recording method for performing a recording operation by discharging ink onto a recording medium, comprising the steps of:

a first power generation step of generating first power based on image data;

a second power generation step of generating second power at a non-recording timing of the image data onto the recording medium;

an accumulating step of accumulating the power generated in said first power generation step and said second power generation step in an electrical charging device;

a heating step of supplying the accumulated power in said accumulating step to a heater to heat said heater based on the image data; and a discharge step of discharging the ink from a recording head onto the recording medium based on thermal energy from said heater heated in said heating step.

9. The method according to claim 8, wherein the first power generation step comprises generating an AC signal based on the image data to generate an induced electromotive force in a choke coil based on the AC signal.

10. The method according to claim 8, wherein said accumulating step comprises rectifying the power generated in said first power generation step and said second power generation step to charge the electrical charging device.

11. The method according to claim 10, wherein said accumulating step is effected with a capacitor.

12. The method according to claim 8, wherein the image data utilized in said heating step comprises digital data.

13. The method according to claim 8, wherein in said discharge step said recording head causes a change in state of the ink by the thermal energy applied by said heater to cause the ink to be discharged from a discharge port based on the change in state.

14. The method according to claim 8, wherein the power generation step comprises generating an AC signal based on the image data to generate an induced electromotive force in a transformer.

15. An image recording apparatus for performing a recording operation with a recording head having a heater for discharging ink onto a recording medium, said apparatus comprising:

power generation means for generating power based on image data;

accumulating means comprising an electrical charging device, for accumulating the power generated by said power generation means for storage in said electrical charging device; and supplying means for supplying the stored power from the electrical charging device to the heater of the recording head according to the image data.

16. The apparatus according to claim 15, wherein said power generation means generates an AC signal based on the image data to generate an induced electromotive force in a choke coil based on the AC signal.

17. The apparatus according to claim 15, wherein said accumulating means rectifies the power generated by said power generation means to charge the electrical charging device.

18. The apparatus according to claim 17, wherein the electrical charging device comprises a capacitor.

19. The apparatus according to claim 15, wherein the image data comprises digital data.

20. The apparatus according to claim 15, wherein said recording head causes a change in state of the ink by the thermal energy applied by said heater to cause the ink to be discharged from a discharge port based on the change in state.

21. The apparatus according to claim 15, wherein said power generation means generates an AC signal based on the image data to generate an induced electromotive force in a transformer.

22. An image recording apparatus for performing a recording operation with a recording head having a heater for discharging ink onto a recording medium, said apparatus comprising:

first power generation means for generating first power based on image data;

second power generation means for generating second power at a non-recording timing of the image data onto the recording medium;

accumulating means comprising an electrical charging device, for accumulating the power generated by said first power generation means and said second power generation means for storage in said electrical charging device; and supply means for supplying the stored power from the electrical charging device to the heater of the recording head according to the image data.

23. The apparatus according to claim 22, wherein said first power generation means generates an AC signal based on the image data to generate an induced electromotive force in a choke coil based on the AC signal.

24. The apparatus according to claim 22, wherein said accumulating means rectifies the power generated by said first power generation means and said second power generation means to charge the electrical charging device.

25. The apparatus according to claim 24, wherein the electrical charging device comprises a capacitor.

26. The apparatus according to claim 22, wherein the image data comprises digital data.

27. The apparatus according to claim 22, wherein said recording head causes a change in state of the ink by the thermal energy applied by said heater to cause the ink to be discharged from a discharge port based on the change in state.

28. The apparatus according to claim 22, wherein said power generation means generates an AC signal based on the image data to generate an induced electromotive force in a transformer.

* * * * *